US011208619B2

(12) United States Patent
Piorkowski et al.

(10) Patent No.: US 11,208,619 B2
(45) Date of Patent: Dec. 28, 2021

(54) UNIT DOSE DETERGENT PRODUCTS WITH EFFECT ON PROTEIN STAINS

(71) Applicant: Henkel IP & Holding GmbH, Duesseldorf (DE)

(72) Inventors: Daniel Thomas Piorkowski, Fairfield, CT (US); Mark A. Granja, Danbury, CT (US); Adam Winfield Germain, Watertown, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 129 days.

(21) Appl. No.: 16/548,299

(22) Filed: Aug. 22, 2019

(65) Prior Publication Data

US 2021/0054317 A1 Feb. 25, 2021

(51) Int. Cl.

| | |
|---|---|
| ***C11D 17/04*** | (2006.01) |
| ***C11D 1/22*** | (2006.01) |
| ***C11D 1/83*** | (2006.01) |
| ***C11D 3/04*** | (2006.01) |
| ***C11D 7/10*** | (2006.01) |
| ***C11D 11/00*** | (2006.01) |
| ***C11D 3/37*** | (2006.01) |
| *C11D 1/74* | (2006.01) |

(52) U.S. Cl.

CPC ..... *C11D 17/045* (2013.01); *C11D 1/83* (2013.01); *C11D 3/3753* (2013.01); *C11D 7/10* (2013.01); *C11D 11/0017* (2013.01); *C11D 1/22* (2013.01); *C11D 1/74* (2013.01)

(58) Field of Classification Search

None

See application file for complete search history.

(56) References Cited

U.S. PATENT DOCUMENTS

| | | | | |
|---|---|---|---|---|
| 4,253,842 | A * | 3/1981 | Ehrlich | C11D 17/041 510/277 |
| 4,747,976 | A * | 5/1988 | Yang | C11D 3/046 510/220 |
| 4,885,105 | A * | 12/1989 | Yang | C11D 3/02 510/296 |
| 2004/0072709 | A1* | 4/2004 | Wiedemann | C11D 17/042 510/296 |
| 2010/0167974 | A1* | 7/2010 | Wiedemann | C11D 3/48 510/220 |
| 2013/0206638 | A1* | 8/2013 | Wong | C11D 17/0039 206/524.7 |
| 2018/0119070 | A1* | 5/2018 | Miracle | C11D 17/0039 |
| 2019/0048296 | A1 | 2/2019 | Piorkowski | |

FOREIGN PATENT DOCUMENTS

EP 3339436 A1 * 6/2018

* cited by examiner

*Primary Examiner* — Lorna M Douyon

(74) *Attorney, Agent, or Firm* — Bojuan Deng

(57) ABSTRACT

A low dose of borax and of liquid detergent is delivered to wash water in a multi-chamber single dose unit containing borax in a powder chamber and a liquid detergent in a liquid chamber. The treatment removes proteinaceous stains without a proteinase enzyme.

12 Claims, No Drawings

UNIT DOSE DETERGENT PRODUCTS WITH EFFECT ON PROTEIN STAINS

FIELD OF THE INVENTION

The present invention is in the fields of household or industrial cleaning. More particularly, the invention relates to stable unit dose detergent compositions with enhanced effectiveness against protein stains.

BACKGROUND OF THE INVENTION

Unit dose (also called single dose) detergent products are often found by some consumers to be preferred for use in cleaning and laundry applications. Unit dose products have several advantages, including convenience of use and dispensing, and avoiding or minimizing skin contact with potentially irritating cleaning compositions.

Of all the stains encountered in laundering fabrics in the home or in commercial establishments such as hotels, those derived from proteins tend to be the toughest to mitigate with conventional liquid detergents based on anionic, cationic, amphoteric, and nonionic surfactants. To conquer stains like blood, grass, and proteinaceous foods, it is sometimes necessary to formulate the detergent composition with protease enzymes, which adds complications and high costs.

Unit dose detergent products often employ water-soluble or water-degradable films such as polyvinyl alcohol (PVOH) or polyvinyl acetate (PVA) to form a sealed container (pac or pack), optionally with multi-compartments, for storing detergent compositions. Traditional single dose formulations hold liquid formulations based on commonly used solvent systems that include water, glycerin, and glycols, for example. These add weight and cost to the formulations.

Borax is a known so-called booster for laundry detergents. It has long been used by consumers to increase whiteness, soften hard water, remove soap residue, disinfect clothing, and increase the ability of the detergent to remove acidic stains and grease and oil stains. Instructions of use for such purposes include dosing at a half cup or more of borax to a washing machine's pre-soak cycle.

Therefore, there is a continuing need in the art for a unit dose product having reduced costs and increased effectiveness against protein stains. Other desirable features and characteristics of the unit dose product in accordance with the present invention will become apparent from the subsequent detailed description of the invention and the appended claims.

BRIEF SUMMARY OF THE INVENTION

It has been surprisingly found that washing laundry in the presence of certain low levels of borax and of a liquid laundry detergent not only cuts expenses involved in providing the cleaning materials but also tends to remove protein stains even when the detergent composition is formulated without any protease that would otherwise be required. The doses are such that a protein stain cleaning amount of detergent and borax can be provided in a multi-chamber unit dose made from a water-dispersible or -soluble film material. In various embodiments, the current teachings are drawn both to the multi-chamber unit doses containing the detergent and borax, and to their use in commercial washing machines to clean laundry and remove proteinaceous stains such as those from blood and from grass, without having to be formulated with a protease.

In one embodiment, a multi-chamber single dose unit comprises a powder chamber and a liquid chamber, wherein the liquid chamber contains a liquid detergent and the powder chamber contains borax. In a particular embodiment, the powder chamber contains only borax. In non-limiting fashion, the liquid chamber holds 7.5 to 18 grams of a liquid detergent and the powder chamber holds 0.5 to 7.5 grams of borax.

In various embodiments, the liquid chamber is configured to contain 9 to 12 grams of liquid detergent and the powder chamber to contain 1.5 to 5 grams of borax. In further embodiments, the powder chamber comprises 2 to 4 grams of borax and the liquid chamber comprises about 10.5 grams of liquid detergent. In yet other embodiments described herein, the powder chamber comprises 2 grams of borax and the liquid chamber comprises about 10.5 grams of liquid detergent. In embodiments of the single unit dose according to the current teachings, the powder chamber contains only borax.

The liquid detergent is characterized by containing 10-100% by weight surfactant, or 10% to 75% by weight surfactant, or 40-60% by weight surfactant. In an embodiment, the liquid detergent comprises about 45% by weight surfactant. These surfactants can be selected from nonionic surfactants, anionic surfactants, or cationic surfactants. For example, the detergent contains anionic surfactant and nonionic surfactant in non-limiting fashion.

The single dose unit as described herein can contain both a nonionic surfactant and an anionic surfactant. Exemplary are an alcohol ethoxylate and a sulfonate, respectively.

Advantageously, in embodiments described herein, the liquid detergent is formulated to be free of protease. Use of the single dose unit thus involves removing protein stain, such as grass and blood as common representatives of such stains, without the added expense of formulating with enzymes.

In various embodiments, the single unit dose has a liquid chamber and a powder chamber enclosed in a polyvinyl alcohol film, preferably having a thickness of 60 to 100 micrometers, or having a thickness of 74 to 88 micrometers.

The single dose units described are used in a method for removing a blood stain from a fabric, comprising washing the fabric in wash water in a top loading or front-loading washing machine, and adding at least one multi-chamber single unit dose according to any of the current teachings to the wash water. In an embodiment, the method involves adding only one single unit dose to the wash water.

In another embodiment, a method of cleaning fabrics comprises washing a load of the fabrics in a top loading washing machine or in a front-loading washing machine in wash water containing 7.5 to 18 grams of liquid detergent and 0.5 to 7.5 grams of borax, wherein the liquid detergent comprises 25% to 75% by weight surfactant. In a further non-limiting embodiment, the wash water contains 9 to 12 grams of liquid detergent and 1.5 to 5 grams of borax. Conveniently, the method can be carried out by adding the borax and liquid detergent together is a single dose unit described herein. But comparable results at stain removal are obtainable by adding the borax and detergent separately.

DETAILED DESCRIPTION OF THE INVENTION

In one aspect, the present teachings are directed to a single dose unit product containing a powder chamber and a liquid chamber. The single dose unit and the chambers are formed from a water-soluble or water-dispersible film material.

Together the film and the chambers form a single dose unit, or equivalently a container, containing borax and a liquid detergent. The powder chamber containing certain low doses of one of a number of related minerals or chemical compounds that are referred to as borax; the liquid chamber holds a dose of liquid detergent. It has been surprisingly observed that use of the borax dose and the liquid detergent dose together, such as by adding the single dose unit filled with borax and liquid detergent to wash water provides a noticeable reduction in proteinaceous stains on fabric washed in the presence of the borax and liquid detergent components, even though the components are formulated without a protease. In various embodiments, the detergent and borax doses are conveniently to be delivered in a dual chamber single dose unit containing a liquid composition in one chamber and a borax compound in the other, especially an embodiment where the borax compound is present in the single dose unit as a 100% solid.

Water Dispersible or -Soluble Film

The container of the unit dose composition is made from a water-soluble or water-dispersible material—in film form—that dissolves, ruptures, disperses, or disintegrates upon contact with a sufficient amount of water over a period of time, thereby releasing the composition or cleaning system contained within the container. The films and single dose units prepared from them are known in the art.

In various embodiments, the water-soluble or water-dispersible film, which may be in the form of a pouch, is formed from a water-soluble polymer. Non-limiting examples of suitable water soluble polymers include polyvinyl alcohol, polyvinyl acetate, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycol, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, film forming cellulosic polymer, polyanhydride, polysaccharide, polyalkylene oxide, polycarboxylic acid and salt, polyaminoacid, polyamide, natural gums, polyacrylate, water-soluble acrylate copolymer, methylcellulose, carboxymethylcellulose sodium, dextrin, ethylcellulose, maltodextrin, polymethacrylate, polyvinyl alcohol copolymer, and mixtures thereof. In preferred embodiments, the water-soluble or water-dispersible film material is selected from polyvinyl alcohol or polyvinyl acetate.

In some embodiments, the water-soluble or water-dispersible film material of the container can be polyvinyl alcohol, polyvinyl acetate, film forming cellulosic polymer, polyacrylic acid, polyacrylamide, polyanhydride, polysaccharide, or a mixture thereof. In some embodiments, the water-soluble or water-dispersible film material is polyvinyl alcohol or polyvinyl acetate. In a preferred embodiment, the water-soluble or water-dispersible container is made from a lower molecular weight water-soluble polyvinyl alcohol film-forming resin.

Suitable PVOH films are sold under the trade name MONOSOL® (e.g., Monosol film M8630, Monosol film M8720, Monosol film M8312, available from MonoSol LLC, Merrillville, Ind.). The preferred grade is MONOSOL® film having a weight average molecular weight range of about 55,000 to 65,000 and a number average molecular weight range of about 27,000 to 33,000. Other suitable PVOH film forming resins include those sold under trade name Solublon®, available from Aicello Corporation (e.g., Solublon® PT75, Aiichi, Japan; North American subsidiary in North Vancouver, BC, Canada).

In some embodiments, the water-soluble or water-dispersible container may further contain a cross-linking agent. In one embodiment, the cross-linking agent is boric acid or sodium borate.

The water-soluble or water-dispersible container (e.g., pouch or pack) of the present invention may be in any desirable shape and size, e.g., square, rectangular, oval, elliptoid, superelliptical, or circular shape.

In various embodiments, the film material of the container has a thickness of from about 50 to about 120 microns, from about 60 to about 100 microns, or from about 74 to 88 microns.

The water-soluble or water-dispersible container of the present invention may be prepared in any suitable way, such as via molding, casting, extruding or blowing, and is then filled using an automated filling process, as known in the prior art.

Liquid Detergent—Nonionic Surfactants

The liquid detergent is characterized by containing 10-100% or 20-100% or 10-75% or 40-60% by weight of one or more surfactants. The surfactant is selected from an anionic surfactant, a nonionic surfactant, a cationic surfactant, an ampholytic surfactant, and a zwitterionic surfactant. The liquid detergent may comprise a mixture of these surfactants.

Examples of nonionic surfactants include, without limitation, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof. In these, the polyoxyalkylene part of the molecule contains a suitably high proportion of ethoxylation to render the surfactant water soluble. In particular embodiments, the nonionic surfactants are selected from ethoxylated compounds. In some embodiments, the nonionic surfactant is an alcohol ethoxylate (AE), alcohol propoxylate, or a mixture thereof. In other embodiments, the nonionic surfactant is AE.

In various embodiments, a suitable alcohol ethoxylate is an adduct of from 2 to 8 moles ethylene oxide with 1 mole $C_{10}$-$C_{20}$-fatty alcohol. The carbon chain of the fatty alcohol is linear or branched and contains an odd or even number of carbon atoms. In various embodiments, the fatty alcohol is a mixture, such as a $C_{12}$-$C_{15}$ alcohol indicating a mixture of fatty alcohols with chain lengths of 12, 13, 14, and 15 carbons. Apart from fatty alcohols derived from naturally occurring fatty acids, suitable alcohols include branched alcohols, particularly oxo alcohols. Oxo alcohols are alcohols that are prepared by adding carbon monoxide and hydrogen to an olefin to obtain an aldehyde using the hydroformylation reaction, and then hydrogenating the aldehyde to obtain the oxo alcohol. Nonionic surfactants are commercially available from a variety of suppliers.

Liquid Detergent—Anionic Surfactants

Anionic surfactants in the liquid detergent include sulfonates, sulfates, and soaps. Suitable anionic surfactants of the sulfate and sulfonate type broadly include those known in the art, for example alkylbenzene sulfonates containing alkyl groups such as $C_{9-15}$-alkyl groups; olefin sulfonates, i.e., mixtures of alkene and hydroxyalkane sulfonates; and also disulfonates of the type obtained, for example, from $C_{12-18}$-mono-olefins containing an internal or terminal double bond by sulfonation with gaseous sulfur trioxide and subsequent alkaline or acidic hydrolysis of the sulfonation products.

Suitable surfactants of the sulfate type include sulfuric acid monoesters of primary alcohols of natural or synthetic origin, e.g., of fatty alcohols, such as coconut oil fatty alcohols, tallow fatty alcohols, oleyl alcohol, lauryl alcohol, myristyl alcohol, palmityl alcohol, or stearyl alcohol, or $C_{10-20}$ oxoalcohols and secondary alcohols having the same carbon chain length. Sulfuric acid monoesters of aliphatic primary or secondary alcohols ethoxylated with from 1 to 6 moles ethylene oxide are also suitable. Sulfated fatty acid alkanolamides and sulfated fatty acid monoglycerides are also suitable.

Other suitable anionic surfactants are dialkane sulfonates of the type obtainable from $C_{12-18}$-alkanes by sulfochlorination or sulfoxidation and subsequent hydrolysis or neutralization, or by addition of bisulfites onto olefins; and also esters of α-sulfofatty acid, for example, the α-sulfonated methyl or ethyl esters of dihydrogenated coconut oil, palm kernel oil or tallow fatty acids.

In some embodiments, the anionic surfactant can be linear alkylbenzene sulfonic acid (LAS) or a salt thereof, alkyl ethoxylated sulphate, alkyl propoxy sulphate, alkyl sulphate, or a mixture thereof. Linear alkylbenzenesulfonate (LAS) is a water-soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids.

However, in other embodiments, the liquid detergent is substantially free of LAS. In other embodiments, the liquid detergent is substantially free of a sulfate surfactant.

Soaps suitable for the liquid detergent are those of the type known in the art, especially the alkali metal salts of saturated or unsaturated $C_{10-24}$-fatty acids. Soaps containing a relatively large number of carbon atoms, more especially from 14 to 24 carbon atoms, are typically used for foam inhibition. Soaps of saturated $C_{20-24}$-fatty acids are particularly suitable as foam inhibitors for detergents based on sodium triphosphate as builder, whereas detergents predominantly containing zeolite builders are usually more effectively foam-inhibited by soaps containing only from 14 to 18 carbon atoms, particularly at low washing temperatures.

In some embodiments, the liquid detergent contains a zwitterionic surfactant or an amphoteric surfactant. A zwitterionic surfactant is a net-neutrally charged molecule that has positive and negative charges. Some simple amphoteric molecules can only form a net positive or negative charge depending on the pH. Other amphoteric molecules can form a net-neutral charge, depending on the pH. Examples of zwitterionic materials include betaine.

In some embodiments, the anionic surfactant and the non-ionic surfactant are present in a weight ratio of from 1:9 to 9:1, from 3:7 to 7:3, or from 4:6 to 6:4. In some embodiments, the anionic surfactant and the non-ionic surfactant are present in a weight ratio of from 1:9 to 9:1, from 1:8 to 8:1, from 1:7 to 7:1, from 1:6 to 6:1, from 1:5 to 5:1, from 1:4 to 4:1, from 1:3 to 3:1, or from 1:2 to 2:1. In some embodiments, the anionic surfactant and the non-ionic surfactant are present in a weight ratio of from 2:3 to 3:2, from 2:5 to 5:2, from 3:4 to 4:3, from 3:5 to 5:3, or from 3:7 to 7:3. In some embodiments, the anionic surfactant and the non-ionic surfactant are present in a weight ratio of about 1:1.

In some embodiments, the liquid detergent contains both an alcohol ethoxylsulfate (AES), and an alcohol ethoxylate (AE). In other embodiments, the surfactant system does not contain a sulfate surfactant.

As used herein, AES refers to an anionic surfactant that is a polyethoxylated alcohol sulfate, such as those sold under the trade name Steol® 25-3S/60 from Stepan (60% active). Such AES materials, also known as alkyl ether sulfates or alkyl polyethoxylate sulfates, are those that correspond to the formula (I):

$$R'—O—(C_2H_4O)n\text{-}SO_3M' \quad (I)$$

wherein R' is a $C_8$-$C_{20}$ alkyl group, n is from 1 to 20, and M' is a salt-forming cation, preferably, R' is $C_{10}$-$C_{18}$ alkyl, n is from 1 to 15, and M' is sodium, potassium, ammonium, alkylammonium, or alkanolammonium. In another embodiment, R' is a $C_{12}$-$C_{16}$ alkyl, n is from 1 to 6 and M' is sodium. In another embodiment, the alkyl ether sulfate is sodium lauryl ether sulfate (SLES).

The alcohol ethoxylate (AE) can be selected from primary and secondary alcohol ethoxylates, exemplified by $C_8$-$C_{20}$ aliphatic alcohols ethoxylated with an average of from 1 to 20 moles of ethylene oxide per mole of alcohol, as well as by $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$ or $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In various embodiments, the AE has Formula (II):

$$R_2—(—O—C_2H_4—)_m—OH \quad (II)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In cases (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

One suitable AE is Tomadol® 25-7 (available from Air Products). Other suitable AEs include Genapol® $C_{200}$ (available from Clariant), which is a coco alcohol having an average degree of ethoxylation of 20.

Builders

The liquid detergent optionally includes a builder. Builders are organic and inorganic substances capable of precipitating or complexing calcium ions. Inorganic substances include water-soluble alkali metaphosphates, alkali polyphosphates, and pentasodium triphosphates. Organic substances include aminopolycarboxylic acids, such as nitrilotriacetic acid, ethylenediamine tetra-acetic acid, diethylenetriamine penta-acetic acid and higher homologs. Phosphorus-containing organic complexing agents include without limitation water-soluble salts of alkane polyphosphonic acids, amino- and hydroxyalkane polyphosphonic acids, and phosphonopolycarboxylic acids; these include for example methane diphosphonic acid, dimethylaminomethane-1,1-diphosophonic acid, aminotrimethylene triphosphonic acid, ethylenediamine tetramethylene tetraphosphonic acid, diethylenetrianinepentanethylenepentaphosphonic acid, 1-hydroxyethane-1,1-diphosphonic acid, and 2-phosphonobutane-1,2,4-tricarboxylic acid.

Among the organic builders, N- and P-free polycarboxylic acids of the type which form complex salts with calcium ions, including polymers containing carboxyl groups, are exemplified. Low molecular weight compounds, such as citric acid, 2,2'-oxydisuccinic acid, and carboxymethyloxysuccinic acid are suitable. Suitable polymeric polycarboxylic acids broadly have a molecular weight of from 350 to about 1,500,000 in the form of a water-soluble salt. Particularly preferred polymeric polycarboxylates have a molecular weight in the range of from 500 to 175,000, and more especially in the range of from 10,000 to 100,000. Polymeric polycarboxylates such as these include such compounds as polyacrylic acid, poly-α-hydroxyacrylic acid, polymaleic acid and also copolymers of corresponding monomeric carboxylic acids with one another or with ethylenically unsaturated compounds, such as vinylmethylether. The water-soluble salts of polyglyoxylic acid are also suitable.

Other Ingredients

In addition to the surfactant, the liquid detergent can contain optional additional ingredients like the optional builders. Other ingredients include without limitation a fragrance composition, a color care agent, a soil releasing polymer, an anti-disposition agent, a softening agent, or a combination thereof. It may also comprise a whitening agent, a brightening agent, a color/texture rejuvenating agent, a bleaching catalyst, a bleaching agent, a bleach activator, a buffer, a surfactant stabilizer, a neutralization agent, a builder, a dye (colorant), a dispersing agent, a defoamer, an anticorrosion agent, a deodorizing agent, a preservative, a bittering agent, and/or a biocidal agent.

Powder Chamber

The powder chamber contains borax and no other ingredients. In a preferred embodiment, the powder chamber contains a suitable low dose of borax that when delivered to wash water by the deterioration of the single unit dose will combine with the liquid detergent of the liquid chamber to remove or partially remove proteinaceous stains. Advantageously, the effect is observed in formulations that contain no added protease.

Borax as the term is used here covers a number of related compounds. It is also known as sodium borate, sodium tetraborate, sodium metaborate, sodium pentaborate and disodium tetraborate. It is formally a sodium salt of boric acid. As used herein, borax refers to any of these, as well as related minerals or chemical compounds that differ in their crystal water content. Borax is available anhydrous and as an octahydrate, pentaborate, or decahydrate. Commercially sold borax is partially dehydrated.

While the recommended dose of borax in a laundry application is half a cup per load or more, the current teachings provide a single dose unit with about 1.5 to 5 grams of borax to be used in combination with, in one embodiment, 9 to 12 grams of liquid detergent. In a non-limiting example, with 90° F. wash studies, it was found that adding 2 to 4 grams of borax along with about 10.5 grams of liquid detergent enables a boost of performance on proteinaceous stains such as grass and blood, even though the system (i.e. the dual chamber single dose unit with borax and detergent) is free of protease. Adding borax at these levels provided a more effective product compared to a control that was liquid detergent only with no borax.

In a further aspect, the present invention provides a method of using the liquid composition of the present invention for cleaning. For example, a liquid composition or unit dose composition of the present invention may be added to a wash liquor in which laundry is present, or to which laundry will be added. It may be used in combination with other laundry detergent compositions, such as, e.g., fabric softeners or stain removers. It may also be used in an automatic washing machine operation and added directly to the drum or to the dispenser drawer of the machine.

Methods of washing laundry according to the present teachings involve adding liquid detergent and borax to the wash water in amounts and in formulations as described herein. In a particular embodiment, the doses of borax and liquid detergent are added to the wash water in a multi-chamber single dose unit as described herein and containing the borax and detergent. The teachings also provide a method of removing proteinaceous stains such as grass and blood stains. Surprisingly, the multi-chamber single dose units with low doses of borax in a powder chamber are effective against proteinaceous stains, even when the single dose units contain no added proteases.

EXAMPLES

The following examples are illustrative and non-limiting of the compositions of the present invention. Suitable modifications and adaptations of the variety of conditions, formulations, and other parameters normally encountered in the field and which are obvious to those skilled in the art in view of this invention are with in the spirit and scope of the invention.

Example 1: Unit Dose Compositions

As shown in Table 1, unit dose composition was prepared by incorporating functional materials commonly used in a finished liquid detergent product. The bases are added in an amount sufficient to make the pH of the composition to be in a range of from about 7.2 to about 8.2. This liquid detergent was tested on proteinaceous stains in Example 2.

TABLE 1

| | Liquid detergent (% wt) |
|---|---|
| Sodium C12-C14 Alcohol Ethoxysulfate 3EO (AES), 60% active | 26.0 |
| C12-C15 Alcohol Ethoxylate 7EO | 23.1 |
| Coconut Fatty Acid | 10 |
| Other Ingredients | 8.9 |
| Propylene Glycol | 8.2 |
| Glycerin | 12.1 |
| Heavy linear alkyl benzene sulfonate | 5.0 |
| ethanolamine | 3.1 |
| Zeolite water | 6.7 |
| Bittering agent | 0.05 |
| Poly (ethylenimine), ethoxylated, 80% active | 4.5 |
| Fragrance and dye | 1.03 |

Example 2: Comparative Cleaning Performance Test

Formulations A (the liquid detergent of Example 1 and no borax), B (same with 2 g borax), were tested at 90° F. using Grass and blood stains in 120 ppm water on two fabrics (woven blend and knitted cotton) tested in HE front loader.

Residual Stain Indexes (RSI) were collected following the procedure per the ASTM International standard, designated as D4265 (2014), "Standard Guide for Evaluating Stain Removal Performance in Home Laundering". The RSI values are listed in Table 2.

TABLE 2

| Stain | Fabric | Example 1 No borax | Example 1 + 2 g Borax | Example 1 + 4 g borax |
|---|---|---|---|---|
| Grass | Woven Blend | 0.00 | 7.98 | 5.16 |
| | Knitted cotton | 0.00 | −0.21 | 6.87 |
| Blood | Woven Blend | 0.00 | 0.71 | 1.49 |
| | Knitted cotton | 0.00 | 2.25 | 2.51 |

In Table 2, the results are normalized to RSI of 0.00 for the Example 1 formula when it was tested without any borax. For HE front loaders, the addition of 4 g borax improved the stain removal of protease sensitive stains and showed a drop in performance on chocolate ice cream (data not shown). Moving from 4 grams to 2 grams of borax also showed an improvement on grass and blood as well as mud (data not shown) and also lowered the negative impact on chocolate ice cream. In general, the addition of low dose borax showed no improvement on bleachable stains, particulate stains, or oily stains.

Similar results were obtained in a standard top loader: the addition of 4 grams borax improved the stain removal of protein stains like blood and grass but did not have much of an effect on starch stains, bleachable stains, oily stains, or particulate stains.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A multi-chamber single dose unit comprising a powder chamber and a liquid chamber, wherein the liquid chamber comprises 7.5 to 18 grams of a liquid detergent and the powder chamber comprises 0.5 to 7.5 grams of borax, wherein the liquid detergent comprises 10% to 75% by weight surfactant comprising a nonionic surfactant and an anionic surfactant, wherein the powder chamber contains only borax, wherein the liquid chamber and the powder chamber are enclosed in a water-dispersible or water-soluble film, and wherein the multi-chamber single dose unit is free of protease.

2. The single dose unit of claim 1, wherein the liquid chamber comprises 9 to 12 grams of liquid detergent and the powder chamber comprises 1.5 to 5 grams of borax.

3. The single dose unit of claim 1, wherein the liquid detergent comprises an alcohol ethoxylate and a sulfonate.

4. The single dose unit of claim 1, wherein the liquid detergent comprises 40% to 60% by weight surfactant.

5. The single dose unit of claim 1, wherein the liquid detergent comprises about 45% by weight surfactant.

6. The single dose unit of claim 1, wherein the powder chamber comprises 2 to 4 grams of borax and the liquid chamber comprises about 10.5 grams of liquid detergent.

7. The single dose unit of claim 1, wherein the powder chamber comprises 2 grams of borax and the liquid chamber comprises about 10.5 grams of liquid detergent.

8. The single dose unit of claim 1, wherein the liquid chamber and the powder chamber are enclosed in a polyvinyl alcohol film having a thickness of 60 to 100 micrometers.

9. The single dose unit of claim 8, wherein the liquid chamber and the powder chamber are enclosed in a polyvinyl alcohol film having a thickness of 74 to 88 micrometers.

10. A method for removing a blood stain from a fabric, comprising washing the fabric in wash water in a top loading or front-loading washing machine, and adding at least one multi-chamber single dose unit according to claim 1 to the wash water.

11. The method according to claim 10, comprising adding only one single dose unit to the wash water.

12. A method for removing a grass stain from a fabric, comprising washing the fabric in wash water in a top loading or front-loading washing machine, and adding a multi-chamber single dose unit according to claim 1 to the wash water.

* * * * *